US006290165B1

(12) United States Patent
Mund et al.

(10) Patent No.: US 6,290,165 B1
(45) Date of Patent: Sep. 18, 2001

(54) AUTOMATIC CHEESE WINDER AND METHOD FOR OPERATING AN AUTOMATIC CHEESE WINDER

(75) Inventors: Manfred Mund, Herzogenrath; Michael Heines, Nettetal; Michael Iding, Geldern; Torsten Forche; Stefan Terorde, both of Hamminkeln/Dingden; Bernd-Rudiger Theele, Aachen, all of (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/448,844

(22) Filed: Nov. 23, 1999

(30) Foreign Application Priority Data

Nov. 30, 1998 (DE) ..... 198 55 126

(51) Int. Cl.[7] ..... B65H 54/22

(52) U.S. Cl. ..... 242/474; 242/474.1; 242/474.2; 57/281; 198/341.06

(58) Field of Search ..... 242/474, 474.1, 242/474.2; 57/264, 281; 198/341.06

(56) References Cited

U.S. PATENT DOCUMENTS

| | | | | |
|---|---|---|---|---|
| 4,010,907 | * | 3/1977 | Nishiyama et al. | 242/474.2 |
| 4,729,105 | * | 3/1988 | Thompson et al. | 198/341.06 X |
| 4,781,334 | * | 11/1988 | Derichs | 242/474.1 |
| 4,845,937 | * | 7/1989 | Kiriake et al. | 57/281 |
| 4,913,373 | | 4/1990 | Ueda | 242/35.5 |
| 5,323,979 | | 6/1994 | Grecksch et al. | 242/35.5 |
| 5,423,493 | | 6/1995 | Rueth et al. | 242/35.5 |
| 5,509,614 | * | 4/1996 | Nishikawa et al. | 242/474 |
| 5,845,864 | | 12/1998 | Hermanns et al. | 242/474.1 |
| 5,924,273 | | 7/1999 | Bertrams et al. | 57/281 |

FOREIGN PATENT DOCUMENTS

| | | |
|---|---|---|
| 3835634A1 | 5/1989 | (DE) . |
| 4131608A1 | 3/1993 | (DE) . |
| 4233819A1 | 4/1994 | (DE) . |
| 19636661A1 | 3/1998 | (DE) . |
| 19646337A1 | 5/1998 | (DE) . |

* cited by examiner

*Primary Examiner*—Donald P. Walsh
*Assistant Examiner*—Minh-Chau Pham
(74) *Attorney, Agent, or Firm*—Kennedy Covington Lobdell & Hickman, LLP

(57) ABSTRACT

A method for operating an automatic cheese winder, having multiple winding stations (A, B, etc.) and a transportation system (21) for supplying the winding stations with spinning cops (39) and discharging them of empty tubes (40). The spinning cops are furnished by a preceding textile machine (30) having a spinning cop and empty tube transport device (31) communicating with the transportation system (21). The delivery of spinning cops to the winder (25) is continuously monitored by a sensor. A control device (46) of a tube monitor (24) assures that empty tube-equipped transport trays are kept on hand in the transportation system, and the tube monitor via the central control unit (27) initiates a controlled slow-down of the winder (25) into an energy-saving mode. Upon resumption of delivery of the spinning cops, the winder is accelerated from the energy-saving mode to an operating mode.

10 Claims, 2 Drawing Sheets

AUTOMATIC CHEESE WINDER AND METHOD FOR OPERATING AN AUTOMATIC CHEESE WINDER

CROSS-REFERNCES TO RELATED APPLICATIONS

This application claims the benefit of German patent application DE 19855126.6, filed Nov. 30, 1998, herein incorporated by reference.

FIELD OF THE INVENTION

The present invention relates to a method for operating an automatic cheese winder having multiple identical winding stations and a transportation system for supplying the winding stations with spinning cops and for discharging the winding stations of empty tubes. The present invention also relates to an automatic cheese winder having many identical winding stations and a transportation system for supplying the winding stations with spinning cops and for discharging the winding stations of empty tubes.

BACKGROUND OF THE INVENTION

Automatic cheese winders with multiple identical winding stations and a transportation system for supplying the winding stations with spinning cops and for discharging them of empty tubes are known in various embodiments.

One known embodiment relates to automatic cheese winders whose transportation systems have interfaces on the machine end, by way of which spinning cops can be fed into the transportation system and paid-out empty tubes can be removed. The applicable spinning cops are fabricated on preceding textile machines, preferably ring spinning machines, in the production process. They are fed, for instance by means of large-volume shipping containers, to the automatic cheese winders where they are separated by so-called flat round conveyers and are transferred, via cop mounting devices, onto the transport trays of the transportation systems of these automatic cheese winders.

In another known embodiment, the transportation system of the automatic cheese winder is connected, preferably via a so-called converter, to the transport device of the textile machine that produces the spinning cops.

The ring spinning machine and the bobbin winder have special transportation systems, each with machine-specific transport trays for the spinning cops and empty tubes. The spinning cops and empty tubes are transferred from one transportation system to the other transportation system by means of a preferably continuously operating converter as described, for example, in German Patent Publication DE 196 46 337 A1.

To avoid machine down time, the capacities of the connected textile machines, which operate at different speeds, are adapted to one another. In each case, it should be assured that the ring spinning machine, which is substantially slower in its work process and has a disproportionately greater number of work stations, will not have to wait for the bobbin winder.

In order to take into account the differences in the fineness of the yarn produced in a spinning factory, the capacity of the bobbin winder is often selected to be somewhat greater than the capacity of the ring spinning machine connected to it. As a consequence, the bobbin winder has, as a rule, already rewound the supplied spinning cops before the ring spinning machine is doffed again and new spinning cops are available. Until now, the only option in such a case was either to allow the bobbin winder to run empty until new spinning cops arrived, or to simply to shut down the bobbin winder.

Letting the bobbin winder run empty, however, not only means unnecessary energy consumption, but also presents potential problems in the area of the transportation system of the automatic cheese winder since, as a rule, the result is a backup of empty tube-equipped transport trays on the transport paths of the bobbin winder. A backup of transport trays, especially on the tube return path, often leads to blockages in the region of the mouths of the transverse transport paths leading to the winding stations, and these blockages can usually be eliminated only by manual intervention by the operators.

Even the temporary uncontrolled shutoff of the automatic cheese winder if pc delivery is absent can lead to problems. It also has several considerable disadvantages. For example, the yarn is severed at all the winding stations in an uncontrolled shutoff of the automatic cheese winder. Each severed yarn means a loss in quality of the cheese to be completed. Therefore, such unintended yarn cuts should be avoided as much as possible.

An uncontrolled shutoff of the automatic cheese winder also leads to an entirely random distribution of spinning cop- and empty tube-equipped transport trays within the transportation system. When spinning cop delivery resumes, this entirely uncontrolled distribution of the transport trays leads to repeated backups in the area of the mouths of the transverse transport paths. As a rule, each winding station simultaneously discharges one transport tray out onto the tube return path.

There is also the risk that on resumption of spinning cop delivery, problems will arise since in the region of the converter, often there are not enough adequately empty tube-equipped transport trays that can be replaced for new spinning cops at the converter.

As a result, clearing of the Cowemat paths can be delayed. This means that after the ring spinning machine has finished its new spinning cops, the doffing operation cannot immediately ensue since one of its Cowemat paths has still not been completely cleared.

Each stoppage of the ring spinning machine with its large number of work stations (up to 1200 or more spinning spindles) immediately means a considerable drop in production. The uncontrolled shutoff of an automatic cheese winder is not entirely risk-free either. Uncontrolled shutoff requires an even greater overcapacity of the automatic cheese winder as compared to the ring spinning machine.

OBJECT AND SUMMARY OF THE INVENTION

It is accordingly an object of the present invention to improve the operation of automatic cheese winders used in conjunction with spinning machines. This object is attained according to the present invention by providing a novel method for operating an automatic winder. The method comprises continuously monitoring the delivery of spinning cops to the automatic winder. Upon detection of a cessation in the transfer of spinning cops from the transport device of the textile machine to the transportation system of the automatic winder, the automatic winder is slowed down in a controlled fashion to an energy-saving mode placing the winding stations in lockout condition disabling the unwinding of further spinning cops, disabling the transfer of empty tubes from the tube return path of the transportation system of the automatic winder to the transport device of the textile machine, and circulating empty tubes in the transportation system of the automatic winder. Upon resumption of the transfer of spinning cops from the transport device of the textile machine to the transportation system of the automatic winder, the transfer of empty tubes from the tube return path of the transportation system of the automatic winder is enabled to the transport device of the textile machine and the automatic winder is accelerated in a controlled fashion to an operating mode, while the winding stations are maintained in the lockout condition until the tube return path is cleared.

The method according to the invention has the particular advantage that the automatic cheese winder, if spinning cop delivery is absent, is slowed down immediately and in a controlled fashion to an energy-saving mode of operation. It is nevertheless assured that the standard of quality is maintained and that the automatic cheese winder, upon resumption of spinning cop delivery, can immediately be returned to trouble-free normal operation.

Another object of the present invention is to provide an apparatus capable of performing the method of the present invention. The system of the present invention comprises a combination of a textile machine for producing spinning cops and an automatic cheese winder for rewinding the spinning cops into yarn cheeses wherein the automatic winder includes multiple winding stations and a transportation system for supplying the winding stations with spinning cops and for discharging the winding stations of empty tubes. The transportation system includes an empty tube return path. The textile machine has a transport device connected to the transportation system of the automatic winder for transferring spinning cops from the transport device of the textile machine in the transportation system of the automatic winder and transferring empty tubes from the tube return path of the transportation system of the automatic winder to the transport device of the textile machine. The system comprises a sensor device for monitoring delivery of spinning cops to the automatic winder and for producing a non-delivery signal representing the cessation of a delivery of spinning cops to the automatic winder; a tube monitor for receiving and transmitting signals, located in the region of the transportation system of the automatic winder wherein the tube monitor has a control device that communicates functionally with both the sensor device and a central control unit of the automatic winder, wherein the control device of the tube monitor includes a means for receiving the non-delivery signal of the sensor device and a means responsive thereto for first causing empty tubes to be directed to and stored on the tube return path of the transportation system, and when a predetermined number of the empty tubes is on the tube return path, for transmitting a first signal to the central control unit; and a central control unit which includes a means for slowing the operating functions of the automatic winder to an energy-saving mode and for maintaining the energy-saving mode until the central control unit receives a resumption signal from the sensor device of the spinning cops has resumed.

There are many advantageous features of the automatic cheese winder of the present invention. One advantageous aspect of the automatic cheese winder of the present invention is that it is switched over to a more-economical operating mode as early as possible, yet on the other it nevertheless remains assured that enough empty tube-equipped transport trays will always be available in the transportation system of the automatic cheese winder. The empty tubes kept in readiness can as needed, or in other words, when spinning cop delivery resumes, be replaced immediately with spinning cops by the converter, so that as needed the clearing operation of the ring spinning machine can be begun at any time.

In another aspect of the present invention, the sensor monitoring of the spinning cop delivery makes an early reaction to a given situation possible.

That is, a tube monitor disposed in the region of the transportation system of the automatic cheese winder, upon arrival of the non-delivery signal, immediately assures that initially, the empty tube-equipped transport trays arriving over the tube return path are no longer carried in the direction of the converter but instead are diverted via the aforementioned passage, directly to the cop delivery path of the automatic cheese winder and are then held in readiness in the region of the tube return path or the distributor path.

In another aspect of the present invention, the tube monitor is perfectly embodied such that as soon as a predetermined number of empty tube-equipped transport trays has been diverted directly to the cop delivery path, a corresponding signal is issued by the tube monitor controller to the central control unit of the automatic cheese winder. The central control unit thereupon automatically initiates the steps necessary for an energy-saving mode, in a predetermined order.

The number of diverted transport trays is advantageously approximately equivalent to the number of winding stations of the applicable automatic cheese winder. As a rule, such a number is sufficient to assure that on resumption of spinning cop delivery, at least as many empty tube-equipped transport trays are ready at the converter to enable spanning the length of time that the winding stations require for their part to fully unwind spinning cops and thus furnish them to the exchange process at the converter.

The advantageous embodiment wherein the control device of the tube monitor is capable, after a predetermined period of time after receiving a signal of no delivery of spinning cops, of issuing the signal (i) to the central control unit even if the predetermined number of transport trays to be diverted has not yet been reached, assures that if spinning cop delivery is absent, the automatic cheese winder can be slowed down to the energy-saving mode even whenever the predetermined number of empty tube-equipped transport trays to be shunted out, for example because of problems at the winding stations, might not have been reached yet after a predetermined period of time.

After the arrival of a corresponding signal from the tube monitor controller, the central control unit immediately issues a number of control commands such as:

drive (19) of the storage path (5) off;

drive of the suction system off or on only if a circulating cleaner is running;

impound transport trays at tube monitor (24);

drive of the tube cleaning path (10) off;

drive of manual preparation path (12) off;

cop preparation stations (42) off;

winding stations in lockout;

drives (18) of the transverse transport paths (6) off;

"energy-saving mode" control light on;

drive (28) of the cop delivery path (2) off;

drive (29) of the connecting path (7) off;

drive (47) of the tube return path (8) off;

drive (48) of the distributor path (9) off; and drive of the passage (1) off;

which result in the automatic cheese winder being slowed down from the normal operating mode to a defined energy-saving mode. This energy-saving mode assures that the transport trays present in the transportation system of the automatic cheese winder are positioned such that after the doffing of the ring spinning machine and thus upon resumption of winding station delivery, enough empty tube-equipped transport trays will immediately be ready, and thus the automatic cheese winder can be run up to the normal operating mode again without difficulty.

Further details of the invention can be learned from embodiments set forth herein in conjunction with the drawings.

DESCRIPTION OF THE PREFERRED EMBODIMENTS

Figure 1:
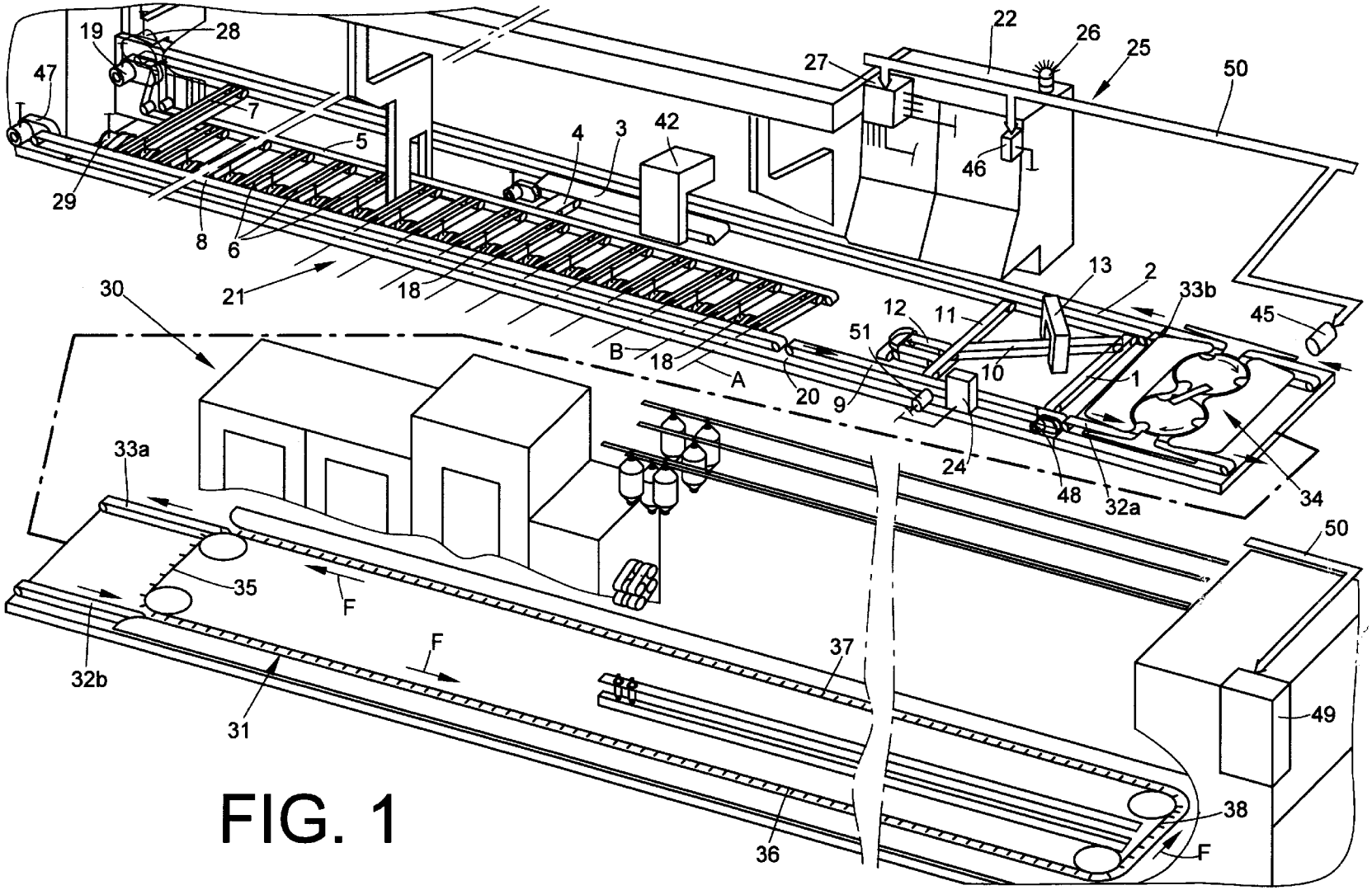
FIG. 1 is a perspective drawing of a combined ring spinning machine and automatic cheese winder, with their transport devices connected via a converter.

The preferred embodiments of the present invention are described with reference to FIG. 1. FIG. 1 is a textile machine combination comprising a ring spinning machine 30 and an automatic cheese winder 25. As indicated, the ring spinning machine 30 has a transport device 31, which is connected via transport paths 33*a* and 32*b* with a continuously operating converter 34. The converter 34 is connected in turn to the transportation system 21 of the automatic cheese winder 25, via transport paths 33*b* and 32*a*. The transport paths 32 and 33 can additionally be extended via a cop bridge, not shown in the present exemplary embodiment. In such a case, a passageway for the operators is provided between the two textile machines.

The transport device 31 of the ring spinning machine 30 substantially comprises a drive belt 35, circulating around the winding stations, which as a rule stands on edge, can be triggered in defined fashion, and has the appropriate fixtures for feeding the transport trays (not shown) of the spinning machine itself, as well as so-called Cowemat paths 36, 37. The Cowemat paths 36, 37 extend along both sides of the ring spinning machine and on the end of the machine are connected via a Cowemat connecting path 38. In the region of the Cowemat paths 36, 37, sensor devices (not shown) are, as a rule, also installed. They detect the degree of filling of these various paths and are preferably connected to the control device 49 of the ring spinning machine 30. The control device 49 communicates, for example, over a data bus 50, with the central control unit 27 of the automatic cheese winder 25.

The Cowemat paths 36, 37 are connected, on the side opposite the Cowemat connecting path 38, to a converter 34 via transport paths 33*a* and 32*b*, respectively. By means of the converter 34, the spinning cops 39 disposed on the transport trays belonging to the spinning machine are reloaded onto transport trays 41 specific to the bobbin winder. At the same time, the converter 34 takes the empty tubes 40 from the transport trays 41 specific to the bobbin winder and puts them back on transport trays of the spinning machine that are revolving in the transport device 31. The spinning cop-laden transport trays 41 are then carried onward over the transport path 33*b* to the transportation system 21 of the automatic cheese winder 25, while the transport trays of the spinning machine return with the empty tubes 40 over the transport path 32*b* to the transport device 31 of the ring spinning machine 30.

In FIG. 1, the various transport paths of the transportation system 21 of the bobbin winder are shown in detail. The illustration of the automatic cheese winder 25 is limited essentially to the energy-supply and control unit 22, disposed on the end of the spinning machine, and to position indications for the winding stations A, B, etc.

The transportation system 21, which serves to supply the winding stations A, B, etc. with spinning cops 39 and discharge them of empty tubes 40, is for instance installed on a chassis 20, which is disposed below the winding stations of the automatic cheese winder. The transportation system 21 has a cop delivery path 2 the same length as the machine and adjoining the transport path 33B. Branching off from the cop delivery path 2 are one or more preparation paths 3, at each of which a so-called cop preparation station 42 is positioned. In the cop preparation stations 42, in a known manner, the back windings of the cops are detached, and tip windings are placed on the tube tips.

One of the preparation stations may also be embodied as a so-called remnant preparation station for spinning cops that have already been partially unwound. On the end, the preparation paths 3 are each connected to the cop delivery path 2 again by a storage path 5 and a suitable disposition of guide elements, which as suggested in FIG. 2, form a discharge path 4*a*.

From the storage path 5, which is switched over from counterclockwise to clockwise operation in alternation, transverse transport paths 6 extend. The transverse transport paths 6, which lead to the individual winding stations A, B, etc., are in turn connected at the end to the tube return path 8, which is adjoined by a distributor path 9.

The transport path 32*a* that leads to the converter 4 is disposed in the extension of the distributor path 9. The distributor path 9 is also connected directly to the cop delivery path 2 via a passage 1.

The transportation system 21 also has a so-called tube cleaning path 10, which branches off from the passage 1 and in whose region a tube cleaner 13 is for instance disposed, via a transverse passage and a manual preparation path 12. The manual preparation path 12 is connected via the transverse passage 11 to both the cop delivery path 2 and the distributor path 9.

In the region of the distributor path 9, there is a tube monitor 24, whose control device 46 communicates via the bus system 50 with the central control unit 27 of the automatic cheese winder 25 and with a sensor device 45 disposed in the region of the transport path 33. A sensor device 51, which detects the degree of filling of the tube return path 8, is also disposed at the entrance to the distributor path 9.

Figure 2:
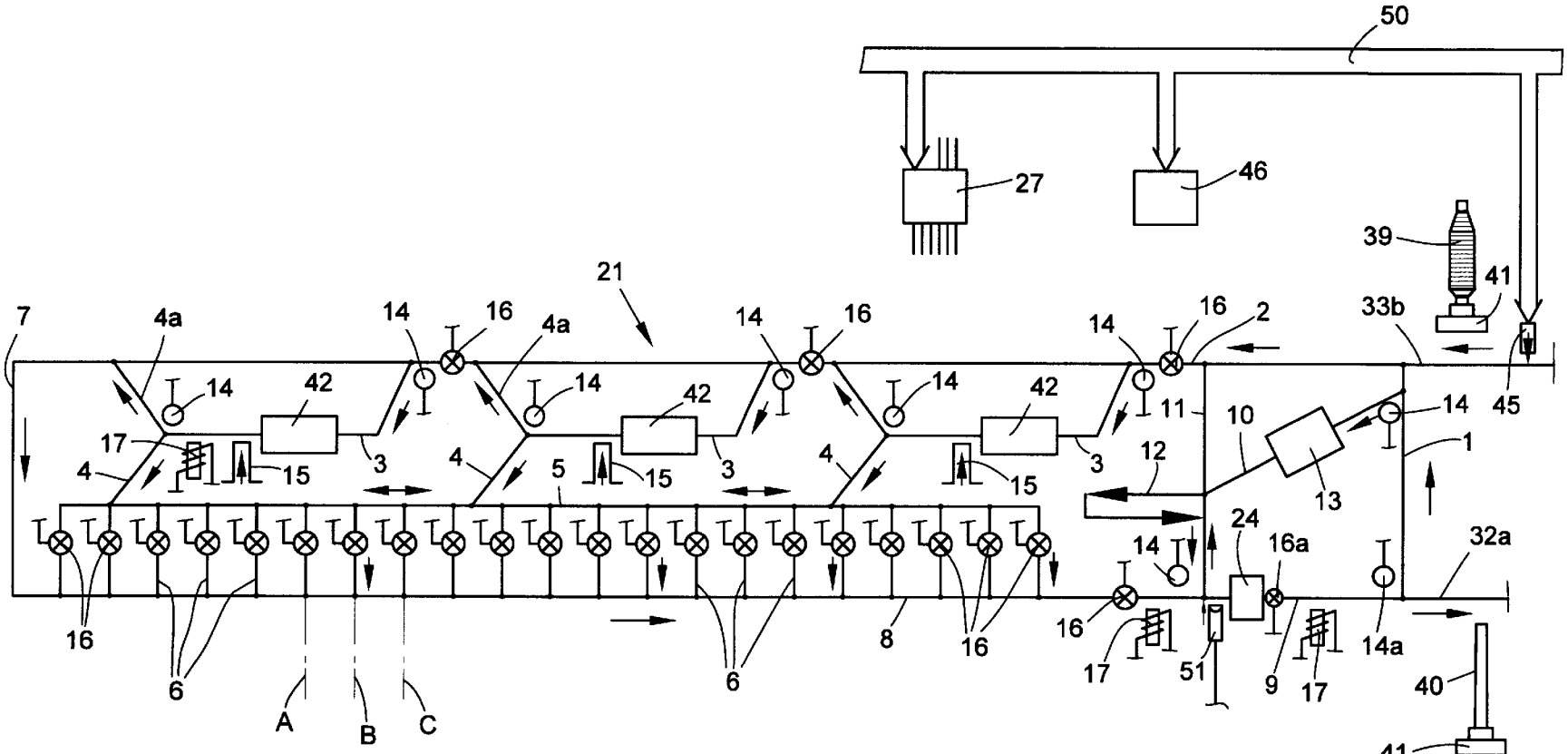
FIG. 2 is a plan view of the transportation system of the automatic cheese winder of the present invention.

The transportation system 21 of the automatic cheese winder 25, which is shown in FIG. 2 and is described in German Patent Publication DE 196 36 661 A1, has an extensive overall system of actuators and sensors, which enables a defined transport of the transport trays 41 within the transportation system 21 of the automatic cheese winder 25.

The transport trays 41 each have a coding device that can be magnetized in a defined way and allows making the loading status of the transport tray at the time perceptible, indicating for instance, whether it is carrying spinning cops or empty tubes.

As seen from FIG. 2, a plurality of electromagnetic shunts 14 are, for instance, positioned in the region of the transportation system 21. They can be supplied with current in a targeted way and in the activated state they make it possible to divert the transport trays 41, surrounded by a ferromagnetic ring, to adjoining transport path.

The transportation system 21 also has numerous sensor devices 16, preferably Hall sensors, which react to coding devices, magnetizable in defined fashion, disposed on the transport trays 41.

The magnetic coding of the information carrying media disposed in the transport trays 41 can be altered via coding coils 17.

Sensor devices are also disposed in the region of the cop preparation stations 42. These sensor devices 15 monitor the success of the preparation devices 42.

Several stop devices are also provided within the transportation system 21, which make it possible to impound transport trays 41 along the specific transport paths.

The preferred mode of operation of the present apparatus in accordance with the present method may thus be understood. When the ring spinning machine 30 ends its bobbin travel, or, in other words, has finished the spinning cops, all the finished spinning cops are simultaneously doffed from the spindles of the ring spinning machine by means of two lateral doffing beams of machine length (not shown) and are transferred to transport trays of the spinning machine, which are in readiness in front of the winding stations on the Cowemat paths 36, 37. Next, the drive belt 35 is indexed onward by one spindle increment and in the process the empty tube-equipped transport trays are positioned in front of the winding stations of the ring spinning machine 30 in such a way that the empty tubes can be manipulated by the gripper devices disposed on the doffing beam.

Once the ring spinning machine 30 has been equipped with empty tubes again and is thus ready for clearing, which is detected by means of a sensor system and reported, for instance via the machine bus 50, to the central control unit 27 of the automatic cheese winder 25, the transport trays with the spinning cops 39 are transported onward by the conveyor belt 35 in the transport direction F, and they reach the converter 34 via the transport path 33*a*. The converter 34 reloads the spinning cops 39 from the transport trays of the spinning machine onto transport trays 41 specific to the bobbin winder. At the same time, the converter takes up the empty tubes 40 brought on the transport trays 41 and puts them down onto the transport trays of the spinning machine. The transport trays 41, now loaded with spinning cops 39, are transferred to the transportation system 21 of the automatic cheese winder 25, while the transport trays of the spinning machine, now loaded with empty tubes 40, are conveyed back to the transport device 31 of the ring spinning machine 30.

The spinning cop delivery along the transport path 33 is monitored continuously via a sensor device 45, which is preferably also connected via the machine bus 50 to the control device 46 of the tube monitor 24. As soon as the sensor device 45 ascertains that no further spinning cop delivery is taking place over the transport path 33*a*, and a device (not further shown) disposed in the region of the ring spinning machine 30 reports that the transport device 31 of the ring spinning machine 30 has been cleared as prescribed, a corresponding signal is issued to the control device 46 of the tube monitor 24, and this device then in turn assures that the transport trays 41 equipped with empty tubes 40 that are arriving along the distributor path 9 will no longer be supplied to the converter 34 over the transport path 32*a*, but instead will be carried via the passage 1 to the cop delivery path 2.

Thus, the electric shunt 14*a* (see FIG. 2) disposed at the entrance to the passage 1 is activated and then deflects the ferromagnetic transport trays 41 in the direction of the passage 1. Via a sensor device 16*a* disposed in the region of the tube monitor 24, the number of empty tubes 40 that have been discharged is also detected. The sensor device 16*a*, preferably embodied as a Hall sensor, can determine from the coding of the transport tray whether that transport tray had already been counted.

The empty tube-equipped transport trays 41 that had been discharged pass over the cop delivery path 2, the connecting path 7 and the tube return path 8 to the distributor path 9 again, where they are finally impounded at the tube monitor 24.

Once a predetermined number of empty tube-carrying transport trays 41 has been shunted out, the control device 46 of the tube monitor 24 issues a signal (i) to the central control unit 27 of the automatic cheese winder 25, via the machine bus 50. The central control unit 27 thereupon assures that the automatic cheese winder 25 is slowed down to a controlled energy-saving mode.

Thus, the central control unit 27 of the automatic cheese winder 25 assures that first the drive 19 of the storage path 5 and also the drives 18 of the transverse transport paths 6 are shut off. Furthermore, the drive (not shown) of the suction system of the bobbin winder is turned off, and the winding stations are placed in a "lockout" mode, i.e., spinning cops in the winding position are unwound fully, but no further cop change is begun. The preparation stations 42 are also turned off, and a signal light 26 is switched to blinking or to being constantly on.

After a predetermined period of time, the central control unit 27 assures that the drive 28 of the cop delivery path 2, the drive 29 of the connecting path 7, the drive 47 of the tube return path 8, and the drive 48 of the distributor path 9 are also turned off. The automatic cheese winder 25 is now in a current-saving standby mode, or so-called energy-saving mode.

The automatic cheese winder 25 remains in this energy-saving mode until the central control unit 27 is informed, for instance via the control device 49 of the ring spinning machine 30, that the ring spinning machine 30 is again ready for clearing, and until the signal device 45 reports the delivery of new spinning cops.

When corresponding signals arrive, the central control unit 27 of the automatic cheese winder 25 then automatically assures that the above-described drives of the transportation system 21 are turned on again. This means that the converter 34 can start without delay to take over the spinning cops 39 furnished by the ring spinning machine, since enough empty tubes 40 are immediately available at the converter, since they have been backed up until this time at the tube monitor 24.

When the sensor device 51 at the entrance to the distributor path 9 detects that the tube return path 8 has been cleared, the lockout of the winding stations is undone. Next, the transport trays that until that time have been in the winding positions of the winding station along the transverse transport paths 6, are shunted out to the tube return path 8 and carried away without complications via the tube return path 8.

The above-described manner of communicative connection between the sensor device 45 and the tube monitor 24, or its control device 46, and between the tube monitor 24 and the central control unit 27 of the automatic cheese winder 25 represents merely one possible exemplary embodiment. Other variants of a functional linkage of this component are entirely conceivable as well, without thereby departing from the general concept of the invention.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed:

1. In a system comprising in combination a textile machine for producing spinning cops and an automatic winder for rewinding the spinning cops into yarn cheeses, wherein the automatic winder includes multiple winding stations and a transportation system for supplying the winding stations with spinning cops and for discharging the winding stations of empty tubes, the transportation system including an empty tube return path, and wherein the textile machine has a transport device connected to the transportation system of the automatic winder, for transferring spinning cops from the transport device of the textile machine to the transportation system of the automatic winder and transferring empty tubes from the tube return path of the transportation system of the automatic winder to the transport device of the textile machine, a method of operating the automatic winder comprising:

a) continuously monitoring the delivery of spinning cops to the automatic winder;

b) upon detection of a cessation in the transfer of spinning cops from the transport device of the textile machine to the transportation system of the automatic winder, slowing the automatic winder in a controlled fashion to an energy-saving mode placing the winding stations in lockout condition disabling the unwinding of further spinning cops, disabling the transfer of empty tubes from the tube return path of the transportation system of the automatic winder to the transport device of the textile machine, and circulating empty tubes in the transportation system of the automatic winder; and c) upon resumption of the transfer of spinning cops from the transport device of the textile machine to the transportation system of the automatic winder, enabling the transfer of empty tubes from the tube return path of the transportation system of the automatic winder to the transport device of the textile machine and accelerating the automatic winder in a controlled fashion to an operating mode, while maintaining the winding stations in the lockout condition until the tube return path is cleared.

2. A system comprising a combination of a textile machine for producing spinning cops and an automatic cheese winder for rewinding the spinning cops into yarn cheeses wherein the automatic winder includes multiple winding stations and a transportation system for supplying the winding stations with spinning cops and for discharging the winding stations of empty tubes, the transportation system including an empty tube return path, and wherein the textile machine has a transport device connected to the transportation system of the automatic winder, for transferring spinning cops from the transport device of the textile machine in the transportation system of the automatic winder and transferring empty tubes from the tube return path of the transportation system of the automatic winder to the transport device of the textile machine, the system comprising:

a) a sensor device for monitoring delivery of spinning cops to the automatic winder and for producing a non-delivery signal representing the cessation of a delivery of spinning cops to the automatic winder;

b) a tube monitor for receiving and transmitting signals, located in the region of the transportation system of the automatic winder wherein the tube monitor has a control device that communicates functionally with both the sensor device and a central control unit of the automatic winder, wherein the control device of the tube monitor includes a means for receiving the non-delivery signal of the sensor device and a means responsive thereto for first causing empty tubes to be directed to and stored on the tube return path of the transportation system, and when a predetermined number of the empty tubes is on the tube return path, for transmitting a first signal to the central control unit;

c) the central control unit including means for slowing the operating functions of the automatic winder to an energy-saving mode and for maintaining the energy-saving mode until the central control unit receives a resumption signal from the sensor device of the spinning cops has resumed.

3. The system of claim 2, and further comprising a device in the region of the tube monitor for detecting empty tubes, wherein the control device of the tube monitor being connected with the empty tube detecting device transmits the first signal to the central control unit of the automatic winder when a predetermined number of empty tubes has been detected by the empty tube detecting device.

4. The system of claim 3, wherein the predetermined number of empty tubes directed to the tube return path is approximately equivalent to the number of winding stations of the automatic winder.

5. The system of claim 2, wherein the control device of the tube monitor includes means for transmitting a second signal to the central control unit after a predetermined period of time following the non-delivery signal without regard to whether the predetermined number of empty tubes has been directed to the tube return path.

6. The system of claim 2, wherein the central control unit includes a means for transmitting at least one first control command in response to the non-delivery signal of the sensor device.

7. The system of claim 6, wherein the first control command is selected from the group consisting of:

a signal for deactivating a drive of a storage path;

a signal for activating or deactivating a drive of a suction system provided that a circulating cleaner is operating;

a signal for impounding a transport tray at the tube monitor;

a signal for deactivating a drive of a tube cleaning path;

a signal for deactivating a drive of a manual preparation path;

a signal for deactivating a cop preparation station;

a signal for placing winding stations in lockout;

a signal for deactivating at least one drive of transverse transport path; and a signal for turning on at least one control light indicating activation of the energy saving mode.

8. The system of claim 7, wherein the central control unit after a predetermined period of time after issuance of the first control command issues at least one second control command selected from the group consisting of:

a signal for deactivating a drive of a cop delivery path;

a signal for deactivating a drive of a connecting path;

a signal for deactivating a drive of the tube return path;

a signal for deactivating a drive of a distributor path; and a signal for deactivating a drive of a passage.

9. The system of claim 2, and further comprising a sensor system in the region of the textile machine, the sensor system including a means for communicating to the central control unit of the automatic winder a clearing signal signifying that the textile machine is ready for clearing and the automatic winder includes a means responsive to the clearing signal for initiating a controlled acceleration of the automatic winder to an operating mode.

10. The system of claim 2, wherein the transportation system includes a distributor path having an entrance and wherein the system further comprises a sensor device for monitoring the number of empty tubes present on the tube return path disposed at the entrance to the distributor path.

* * * * *